US010337260B2

(12) United States Patent
Baustad

(10) Patent No.: US 10,337,260 B2
(45) **Date of Patent: *Jul. 2, 2019**

(54) CABLE PROTECTING DEVICE

(71) Applicant: Roxar Flow Measurement AS, Stavanger (NO)

(72) Inventor: Terje Baustad, Stavanger (NO)

(73) Assignee: Roxar Flow Measurement AS, Stavanger (NO)

( * ) Notice: Subject to any disclaimer, the term of this patent is extended or adjusted under 35 U.S.C. 154(b) by 118 days.

This patent is subject to a terminal disclaimer.

(21) Appl. No.: 15/288,221

(22) Filed: Oct. 7, 2016

(65) Prior Publication Data

US 2017/0022767 A1 Jan. 26, 2017

Related U.S. Application Data

(63) Continuation of application No. 14/787,296, filed as application No. PCT/EP2014/059178 on May 6, 2014, now Pat. No. 9,500,042.

(30) Foreign Application Priority Data

May 8, 2013 (NO) ..... 20130657

(51) Int. Cl.
*E21B 17/02* (2006.01)
*E21B 17/10* (2006.01)

(52) U.S. Cl.
CPC ..... *E21B 17/026* (2013.01); *E21B 17/02* (2013.01); *E21B 17/1035* (2013.01)

(58) Field of Classification Search
CPC ..... E21B 17/1035; E21B 17/026; E21B 17/02
See application file for complete search history.

(56) References Cited

U.S. PATENT DOCUMENTS 2,858,093 A * 10/1958 Knoll ..... E21B 17/1035 174/136
3,171,889 A 3/1965 McCarthy
(Continued)

FOREIGN PATENT DOCUMENTS

GB 2274294 A 7/1994
GB 2398807 A 9/2004
(Continued)

OTHER PUBLICATIONS

Morrish, Susan, "International Search Report," prepared for PCT/EP2014/059178, dated Feb. 9, 2015, four pages.
(Continued)

*Primary Examiner* — Nicole Coy
(74) *Attorney, Agent, or Firm* — Winstead PC

(57) ABSTRACT

This invention relates to a cable protecting device (5) for protecting cables (7) extending over a collar (2) on a pipeline (1), said collar extending around the circumference of the pipe and extending a known length outside said pipeline circumference, the collar having a first and second end surface, the cable protecting device (5) having a length in the direction of the pipeline being longer than the collar (2), and comprising a first recess along the inner surface for enclosing the cable (7) to be protected and a second recess in said inner surface for containing at least a part of the collar (2), the ends of said device at least partially covering the corresponding parts of the collar ends. The length of the second recess corresponds essentially to the length of the collar, each end of said second recess being provided with engaging means (4) adapted to engage with the corresponding end surface of the collar, thus fixing the protecting device (5) to the collar.

15 Claims, 1 Drawing Sheet

(56) References Cited

U.S. PATENT DOCUMENTS

| | | | |
|---|---|---|---|
| 3,940,832 | A | 3/1976 | Kelly et al. |
| 4,603,737 | A | 8/1986 | Spikes |
| 6,588,714 | B2 | 7/2003 | Blane et al. |
| 7,784,537 | B2 | 8/2010 | Baxter |
| 8,627,704 | B2 | 1/2014 | Baxter |
| 2009/0078020 | A1 | 3/2009 | Baxter |
| 2011/0006512 | A1 | 1/2011 | James et al. |

FOREIGN PATENT DOCUMENTS

| | | | |
|---|---|---|---|
| GB | 2415932 | A | 1/2006 |
| WO | WO-19940011609 | A1 | 5/1994 |
| WO | WO-2006073309 | A1 | 7/2006 |

OTHER PUBLICATIONS

Innovar Solutions AS; "5 1/2" × 9 5/8" CableSafe: CS 55120 Heavy Duty Cableclamp"; Sep. 25, 2014; 1 page.

* cited by examiner

CABLE PROTECTING DEVICE

CROSS REFERENCE TO RELATED APPLICATIONS

This patent application is a continuation application of U.S. patent application Ser. No. 14/787,296, filed on Oct. 27, 2015. U.S. patent application Ser. No. 14/787,296 is a national stage filing of International Patent Application No. PCT/EP2014/059178, which was filed on May 6, 2014. International Patent Application No. PCT/EP2014/059178 claims priority from Norwegian Application No. 20130657, which was filed on May 8, 2013. U.S. patent application Ser. No. 14/787,296, International Patent Application No. PCT/EP2014/059178, and Norwegian Application No. 20130657 are incorporated herein by reference.

TECHNICAL FIELD

The present invention in general relates to a cable protecting device for its application within a well bore, for protecting cables extending downwards through the bore holes.

Particularly, the present invention relates to a cable protecting device, which can be easily and rigidly mounted on pipes, especially on connections in downhole pipes or tubing and the like.

BACKGROUND

Extending cables down through wellbores, is a very common exercise, especially in hydrocarbon production/injection and exploration operations. Cable protecting devices in various forms are also known for rigidly holding the cable, to transfer its weight to the well bore conduit or tubing during operation. Such devices also serve to prevent the cable from moving within the well bore, so that it does not undergo abrasion or wearing by impact or rubbing with the well wall or casing. Such movement may take place for example, when a motor of a submerged electric pump, to which the cable is connected, is put on or put off, which trigger vibrations within the well bore. Such movement may also take place during lifting/lowering of any equipment with the cable attached.

Now, the cable protecting devices known in the art are usually mounted on pipes, such as but not limited to production tubing. The cables may be banded or strapped to the production tubing at intervals, for transferring the weight of the cable on the production tubing.

In the prior art known in the field, various cable protecting devices have been taught and disclosed, however there has not been much focus on mounting or installing the cable protecting device conveniently on the connections in the down hole pipes, in a simple, less time consuming and rigid manner. One example (for example publication no. WO 2006/073309) discloses a cable retaining strip having a longitudinally extending cable track for holding the cable. The strip is provided with two attaching members. The cable track and the attaching members have holes for welding the strip to an underlying pipe. A problem related to the protection of the cable is related to connections or pipe joints along the pipe, where a sleeve having a wider diameter than the pipe and the cable has to pass the sleeve or collar. Several cable clamps have been suggested for this use, eg. as shown in WO94/0011609, GB2398807, GB2274294 and US2009/078020 where all of them require fastening means extending around the pipe.

The above prior art document and also other documents do not focus on the fact that mounting the cable protection devices on pipes is time consuming. This is particularly true, because fairly a large number of such devices, are required in each well. Additionally the current devices require more than one person present close to the pipe to install onto, introducing danger of personnel injury in the process.

Additionally, the cable protecting devices or its parts as known in the art, which are known to be mounted on such pipes, for example production tubings, have potential chances of falling off inside the well, which obviously requires substantially expensive, recovery and corrective operations.

SUMMARY

Thus it is an object of this invention to provide a cable protecting device for protecting cables which has a simple arrangement for rigidly mounting it on a pipe joint, especially on a connection in a down hole pipe, so that the mounting and removal operation of the device is not time consuming and simultaneously being sufficiently secure to reduce the chances of falling off of the device or its parts into the well bore. The object of the invention is obtained with a device according to the accompanying claims.

Thus the present invention provides a cable protecting device for protecting cables, which extends over a collar or sleeve on a pipeline. The collar extends around the circumference of the pipeline for a known length and has a first and second end surface. The cable protecting device or clamp according to the invention is longer than the collar, and occupies a sector of the space between the pipe and the casing or borehole outside. The inner surface is preferably curved, with a radius to generally fit smugly on the outside of the pipeline and collar. The inner radius at the ends of the device is therefore smaller than that of the middle part, preferably just slightly larger than that of the pipeline, thus defining a recess in the clamp for enclosing the outer surface and ends of the collar.

According to the invention, the length of the second recess corresponds essentially to the length of the collar and each end of the second recess is provided with engaging means for engaging into the corresponding end surface of the collar. Hence, the cable protecting device is fixed to the collar of the pipeline in a rigid manner, which is substantially less time consuming.

According to a preferred embodiment of the cable protecting device of the present invention at least one of the engaging means is spring loaded so as to apply a force through the engaging means into the corresponding end of the collar.

Preferably, the engaging end of the engaging means is wedge shaped.

More preferably the spring is provided with a release mechanism for allowing the engaging means to engage or disengage into or from said collar end.

Most preferably, the spring loaded is a spring fastened to the protecting device through a fastening means, having a high thermal expansion extending inside one end of the spring, so as to increase the grip on the spring in high temperature environments.

BRIEF DESCRIPTION OF THE DRAWINGS

The invention will be described more in detail below with reference to the accompanying drawing, illustrating the invention by way of example.

FIG. 1*a* illustrates a detail of the fastening means according to a preferred embodiment of the invention.

DETAILED DESCRIPTION

Figure 1:
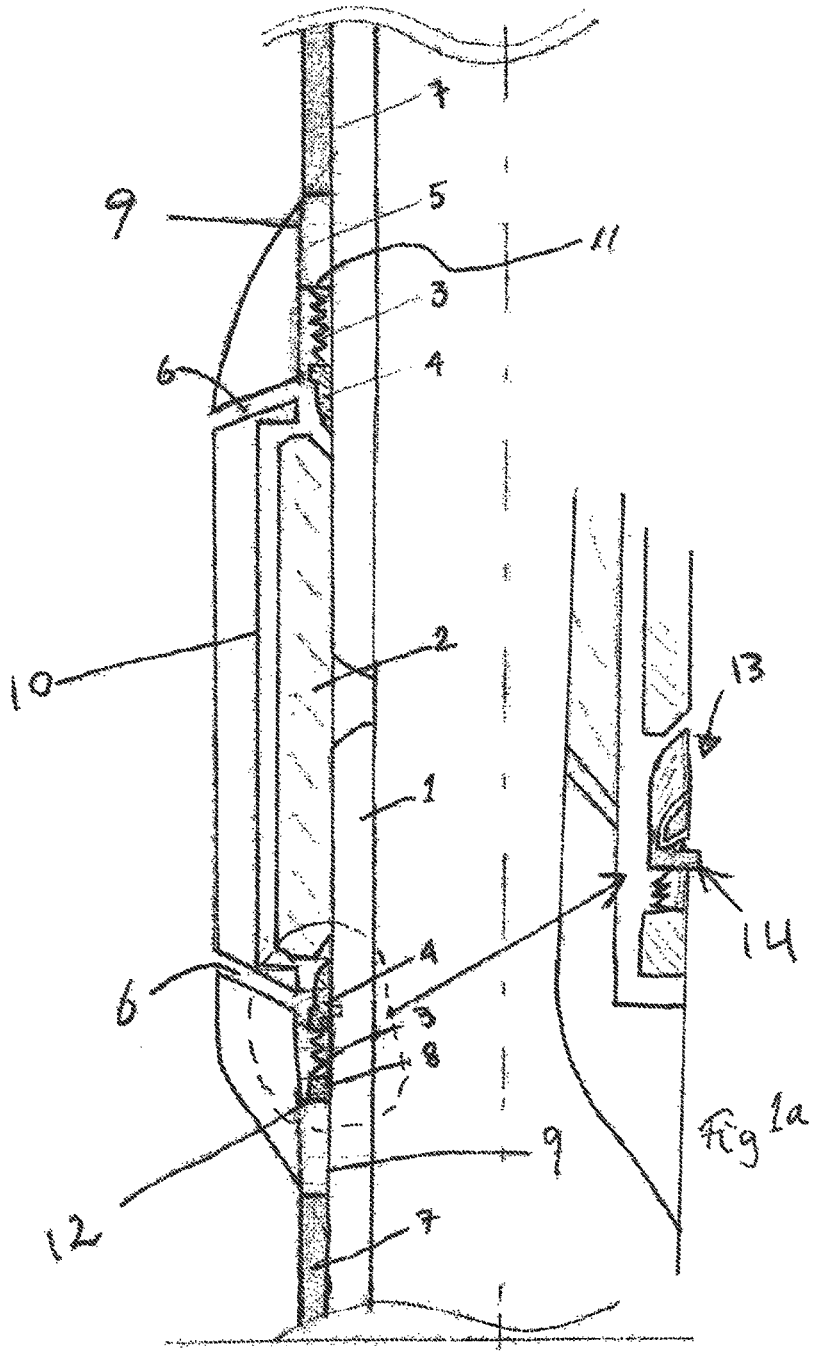
FIG. 1 illustrates a side view of a preferred embodiment of the cable protecting device according to the present invention.

As shown in FIG. 1, the cable protecting device 5 extends along a certain length of the downhole pipe 1. The device 5 has a first recess 9,10 along its inner surface for receiving the cable 7, where the cable passes between the protecting device and the pipe or pipe collar and this way has a protected passages passing the collar. The downhole pipe 1 is equipped with a number of collars 2, for convenience, only one is shown in FIG. 1.

The collar 2 extends around the circumference of the pipeline 1 for a known length range as explained below.

The device 5 has a length in the axial direction of the down hole pipe and is longer than the collar 2. The device 5 also has a second recess 10, on the inner surface for containing a portion of the collar 2. The second recess has two ends 11, 12 as does the collar 2.

The ends of the device 5 extends towards the pipe 1 thus enclosing the collar ends. Now, the collar 2, has dimensions and shape which varies within a known range, with which persons skilled in the art are conversant. Having regard to that, the second recess 10 of the device 5 is so constructed, so that it substantially corresponds to the length of the collar 2 and comfortably sits on collar 2 or a part of it, when fastening means 4 are tightened against the collar ends.

Each end 11,12 of the second recess 10, of the device 5 is provided with engaging mechanism 4 which fixes those ends 11, 12 of the second recess 10 of the device 5, to the corresponding ends of the collar 2 of the downhole pipe.

Preferably, the engaging mechanism comprises a spring 3 loaded to at least one of the engaging means, at any one end 11 or 12 of the second recess 10. The FIG. 1 shows a non-limiting preferred embodiment where a spring 3 is loaded on both the engaging means 4 at either end of the second recess 10 of the device 5.

Preferably, one of the engaging means, is adapted to engage into the interface zone between the collar 2 and the down hole pipe 1.

Preferably, the spring 3 loaded is a spring, fastened to the protecting device 5 through a fastening means 8. The fastening means 8 has a high thermal expansion for ensuring tightened grip during high temperature environment. The spring may be of different types, like helical springs or Belleville washers.

As shown in FIG. 1, the spring 3 is provided with a release mechanism 6 shown as an opening for allowing the engaging means 4 to engage or disengage with and from the collar end by means of a dedicated service tool (not shown).

The engaging means 4 may be wedge shaped for proper gripping and fixing, or may comprise other means for fastening or locking to the collar ends The crux of the invention lies in the construction and configuration of the cable protecting device 5 according to the present invention. The device 5 is so constructed such that, the length of the second recess 10 substantially corresponds with the length of the collar 2.

The device 5 is mounted on the collar 2 of the pipe 1 along the two ends 11, 12 of the second recess 10, which engages with the corresponding ends of the collar 2 by means of the engaging means 4.

Once the engaging mechanism 4 is applied, the device 5 having the cable 7 secured in the first recess 9, gets mounted on the pipe 1 along the collar 2 with a positive lock, thus substantially preventing the chances of the device dropping into the down hole. This also ensures a substantially less time consuming mounting operation.

The spring 3 applies a force through the engaging means 4, into the corresponding ends of the collar 2. As stated before, the spring 3 loaded may be a spring, fastened to the protecting device 5 through a fastening means 8.

The fastening means 8 has a high thermal expansion extending inside one end of the spring, so as to increase the grip on the spring with increasing temperature environments.

It would be clear from FIG. 1 that all parts are mounted from inside of the device 5 so that once the device 5 is mounted, no loose parts fall off into the space between the pipe and the well wall.

FIG. 1 shows only one cable protection device 5 for convenience, but it should be understood that there can be a plurality of such cable protecting devices, suitably installed at intervals along the pipe line 1, for protecting a substantial length of the cable. More than one device may also be mounted in different positions around the circumference of the collar, thus increasing the number of cables being lead past the collar.

In FIG. 1*a* a detail of a preferred locking mechanism is shown having a locking mechanism 13. In this case the engaging means is locked in a position against the spring 3, but once the mechanism is pressed against the pipe a protruding part 14 of the engaging means push the engaging means out of the locking mechanism and snaps into place in the space between the collar and the pipe. This way the mounting is simplified and may be performed automatically using suitable robots or similar.

Thus to summarize the present invention relates to a cable protecting device 5 for protecting cables 7 extending over a collar 2 along a pipeline 1, said collar extending around at least part of the circumference of the pipe and extending a known length outside said pipeline circumference. The collar has a first and second end surface in the pipe direction and the cable protecting device 5 has a length in the direction of the pipeline being longer than the collar 2. The protecting device 5 has a first recess 9 extending along the inner surface for enclosing the cable 7 to be protected. It also comprises a second recess extending in the direction across the pipe direction on the surface facing the pipe and collar for containing at least a part of the collar 2. The ends of said device at least partially covering the collar ends on both sides of the second recess so as to define a space in the pipe direction enclosing a volume suitable for containing the collar in addition to the cable recess 9.

The length of the second recess therefore corresponds essentially to the length of the collar. As a collar by nature will have a small space between it and the pipe each end of the second recess is provided with dynamic engaging means 4 adapted to engage into the space or transition zone between the corresponding end surface of the collar 2 and the pipe 1 thus fixing the protecting device 5 to the collar. It is, however, also possible to provide features in the collar ends for interacting with the engaging means for fastening the protecting device.

At least one of the engaging means 4 is spring loaded 3 so as to apply a force through said engaging means into the corresponding end of the collar. The spring load 3 is preferably provided with a release mechanism 6 for allowing the engaging means 4 to engage/disengage into said collar end by using a suitable tool. The engaging end of the engaging means 4 is preferably wedge shaped for being fastened to the space between the collar and the pipe.

The spring load is provided by a spring fastened to said protecting device 5 through a fastening means 8 and an extension piece having a high thermal expansion extending one end of said springs, so as to increase the grip on the spring with increasing temperature environments. The engaging means may also comprise a locking mechanism 13 for locking the engaging means in a prestrained position against the spring 3. The locking mechanism being provided with a release part 14 pushing the engaging means out of the locked position when being pressed in position against the pipe.

What is claimed is:

1. A cable protecting device for protecting cables extending over a collar on a pipeline, said collar extending around a circumference of the pipeline and extending a known length outside said pipeline circumference, the collar having a first end that forms a first interface zone between itself and the pipeline, and a second end that forms a second interface zone between itself and the pipeline, the cable protecting device having a length in a direction of the pipeline being longer than the collar, and comprising:

an uphole engaging mechanism and a downhole engaging mechanism, wherein at least one of the uphole and downhole engaging mechanisms is configured to engage a respective interface zone, thus fixing the cable protecting device to the collar;

a first recess along an inner surface for enclosing the cable to be protected and a second recess in said inner surface for containing at least a part of the collar, wherein the second recess comprises an axial length that corresponds essentially to the length of the collar, and extends from proximate the uphole engaging mechanism to proximate the downhole engaging mechanism.

2. The cable protecting device according to claim 1, wherein at least one of the uphole and downhole engaging mechanisms is provided with a release mechanism for allowing the at least one of the uphole and downhole engaging mechanisms to at least one of engage and disengage the respective interface zone.

3. The cable protecting device according to claim 1, wherein at least one of the uphole and downhole engaging mechanisms comprise a wedge configured to engage the respective interface zone.

4. The cable protecting device according to claim 3, wherein at least one of the uphole and downhole engaging mechanisms comprises a spring.

5. The cable protecting device according to claim 1, wherein at least one of the uphole and downhole engaging mechanisms comprise a spring.

6. The cable protecting device according to claim 5, wherein the spring is fastened to said cable protection device through a fastening mechanism that comprises a high thermal expansion extending inside one end of said spring for ensuring tightened grip on the spring during high temperature environments.

7. The cable protecting device according to claim 1, wherein at least one of the uphole and downhole engaging mechanisms comprise a locking mechanism for locking the at least one of the uphole and downhole engaging mechanisms in a prestrained positioned against a spring, the at least one of the uphole and downhole engaging mechanisms being provided with a release part pushing the at least one of the uphole and downhole engaging mechanisms out of a locked position when being pressed in position against the pipeline.

8. The cable protecting device according to claim 1, wherein at least one of the uphole and downhole engaging mechanisms is configured to apply a force to a respective end of the collar.

9. A cable protecting device for protecting cables extending over a collar on a pipeline, said collar extending around a circumference of the pipeline and extending a known length outside said pipeline circumference, the collar having a first end that forms a first interface zone between itself and the pipeline, and a second end that forms a second interface zone between itself and the pipeline, the cable protecting device having a length in a direction of the pipeline being longer than the collar and comprising:

an uphole engaging mechanism and a downhole engaging mechanism, wherein at least one of the uphole and downhole engaging mechanisms is configured to engage a respective interface zone, thus fixing the cable protecting device to the collar;

a first recess for enclosing the cable to be protected and a second recess for containing at least a part of the collar, wherein the second recess comprises an axial length that corresponds essentially to the length of the collar, and extends from proximate the uphole engaging mechanism to proximate the downhole engaging mechanism.

10. The cable protecting device according to claim 9, wherein at least one of the uphole and downhole engaging mechanisms is provided with a release mechanism for allowing the at least one of the uphole and downhole engaging mechanisms to at least one of engage and disengage the respective interface zone.

11. The cable protecting device according to claim 9, wherein at least one of the uphole and downhole engaging mechanisms is comprise a wedge configured to engage the respective interface zone.

12. The cable protecting device according to claim 11, wherein at least one of the uphole and downhole engaging mechanisms comprises a spring.

13. The cable protecting device according to claim 9, wherein at least one of the uphole and downhole engaging mechanisms comprise a spring.

14. The cable protecting device according to claim 13, wherein the spring is fastened to said cable protection device through a fastening mechanism that comprises a high thermal expansion extending inside one end of said spring for ensuring tightened grip on the spring during high temperature environments.

15. The cable protecting device according to claim 9, wherein at least one of the uphole and downhole engaging mechanisms comprise a locking mechanism for locking the at least one of the uphole and downhole engaging mechanisms in a prestrained positioned against a spring, the at least one of the uphole and downhole engaging mechanisms being provided with a release part pushing the at least one of the uphole and downhole engaging mechanisms out of a locked position when being pressed in position against the pipeline.

* * * * *